United States Patent [19]

LaFleur

[11] Patent Number: 4,782,894

[45] Date of Patent: Nov. 8, 1988

[54] CEMENTING PLUG CONTAINER WITH REMOTE CONTROL SYSTEM

[76] Inventor: K. K. LaFleur, 210 Clear Lake La., Weatherford, Tex. 76086

[21] Appl. No.: 2,280

[22] Filed: Jan. 12, 1987

[51] Int. Cl.[4] ..... E21B 33/16

[52] U.S. Cl. ..... 166/70; 116/298; 166/113

[58] Field of Search ..... 166/70, 113, 285, 250, 166/383, 66; 137/268, 556; 116/273–275, 298, 271, 274, 284, 285

[56] References Cited

U.S. PATENT DOCUMENTS

| | | | |
|---|---|---|---|
| 464,733 | 12/1891 | Roessler | 116/275 |
| 2,615,519 | 10/1952 | Carr | 166/70 |
| 2,620,037 | 12/1952 | McClendon | 166/113 |
| 3,322,197 | 5/1967 | Baker et al. | 137/268 |
| 3,392,581 | 1/1946 | De Juhasz | 116/284 X |
| 3,631,476 | 12/1971 | Schaffer | 116/298 X |
| 4,046,350 | 9/1977 | Massey et al. | 137/556 X |
| 4,427,065 | 1/1984 | Watson | 166/70 X |

FOREIGN PATENT DOCUMENTS

| | | | |
|---|---|---|---|
| 800494 | 7/1936 | France | 116/298 |

*Primary Examiner*—Hoang C. Dang

*Attorney, Agent, or Firm*—John M. Harrison

[57] ABSTRACT

A cementing plug container and remote control system for enclosing and injecting cementing plugs into the casing and/or drill pipe of an oil or gas well, which includes a shaped housing containing one or more plugs and a plug release mechanism such as an air or hydraulic cylinder for each plug, by operation of appropriate valves located on a control panel remotely located from the cementing plug container. Passage of the plug or plugs from the upper segment of the housing and through the housing assembly bore is registered by a plug pass indicator.

A method for injecting cementing plugs into casing and/or drill pipe in an oil or gas well by remote control using a cementing plug container having a removable dome, at least one remotely controlled plug release mechanism, and a plug pass indicator mechanism.

16 Claims, 7 Drawing Sheets

CEMENTING PLUG CONTAINER WITH REMOTE CONTROL SYSTEM

BACKGROUND OF THE INVENTION

Field of the Invention

This invention relates to the use of cementing plugs, balls, darts and other elements in the cementing of casing in oil and gas wells. More specifically, the invention relates to the remote controlled injection of cementing plugs into casing and/or drill pipe (hereinafter referred to as well pipe) which is hung in a well prior to the cementing operation and to displacement of cement from the well pipe after the cementing process has been completed. The remotely controlled cementing plug container of this invention is designed to release a bottom cementing plug as an interface between the drilling fluid and the cement by opening an air or hydraulic cylinder valve on a control panel remotely located from the cementing plug container and introducing a suitable fluid into the cementing plug container. The bottom cementing plug wipes the drilling fluid from the walls of the well pipe ahead of the cement slurry, reducing dilution. Upon completion of the cementing operation the cementing plug container is again remotely operated to drop a top cementing plug responsive to manipulation of a second air or hydraulic cylinder valve. The function of this plug is to follow the cement and prevent contamination or channeling of the cement with drilling fluid or other fluid used to displace the cement. The cementing plug container is operated to inject the bottom and top cementing plugs from the container housing into the well pipe at specified time intervals by operation of air or hydraulic cylinders responsive to manipulation of the remotely located air or hydraulic cylinder valves cooperating with the air or hydraulic cylinders. The apparatus of this invention is further characterized by a plug pass indicator which positively and both remotely and mechanically indicates when a plug or plugs have passed from the interior of the cementing plug container housing through the bore of the housing. The cementing plug container is specifically designed to quickly, efficiently and inexpensively inject one or more cementing plugs into a length of well pipe in an oil or gas well, both before and after the well pipe cementing operation and to verify that the plugs have been injected into the well pipe by using a control panel located some distance from the well, in order to minimize the time and cost of cementing the well pipe in the well and to maximize safety during the cementing operation.

Description of the Prior Art

Oil and gas well cementing operations have long been effected by the use of cementing plug containers which are typically designed to contain a single cementing plug for a first injection into the well pipe of the well prior to injecting cement and a second plug to displace the residual cement after the cementing operation. In most prior art operations a first plug is initially inserted in the cementing plug container by removing the dome, or top of the container, placing the plug in the housing and then replacing the dome. After the loading operation is completed, the plug is released by manually removing a retaining pin and is then forced downwardly from the cementing plug container and through the well pipe by pumping cement into the well pipe on top of the plug. The cement is forced through the well pipe and upwardly around the outside wall of the well pipe in the annulus between the well bore and the well pipe to secure the well pipe in position in the well. Subsequently, the dome is again removed and a second cementing plug is placed in the housing and forced through the well pipe to clear the well pipe of residual cement. In some operations it may not be necessary to use a bottom cementing plug and under these conditions, a single top cementing plug is used.

It will be recognized by those skilled in the art that this procedure of removing the dome, placing cementing plugs inside the cementing plug container and subsequently replacing the dome in the sequence described above is expensive, constitutes a safety hazard and is time-consuming. Accordingly, this operation adds time and expense to the cost of cementing and completing wells in oil and gas field operations and has been known to cause accidents. Furthermore, it is sometimes difficult to determine whether or not the plug or plugs have actually been forced from the cementing plug container into the well pipe, since no positive indicating mechanism is generally available to make this determination. Accordingly, it is frequently necessary to remove the dome from the housing in order to be sure that each cementing plug has been forced from the cementing plug container and into the well pipe.

An early patent dealing with the insertion of plugs in well pipe is U.S. Pat. No. 2,615,519, dated Oct. 28, 1952, to C. J. Carr. The Carr apparatus includes a vertically disposed tubular body which is provided with an internal bore for carrying at least one plug and at least one spring-loaded cam mechanism which selectively rotates into the housing bore to maintain the plug inside the bore and from the bore to drop the plug into the well pipe. U.S. Pat. No. 4,317,486, dated Mar. 2, 1982, to M. E. Harris, discloses a "Cementing Head Apparatus and Method of Operation". The cementing head is designed for injecting an omega-type cementing plug into a well pipe and carries the plug inside the hollow bore of the housing. A movable plunger is located above the plug and is actuated by an operating fluid such as hydraulic fluid. A control valve is situated below the plug and when the valve is closed, it prevents accidental downward movement of the plug into the well pipe. Following injection of the cement slurry into the well pipe, the valve is opened and the plunger is moved down to push the plug through the valve and beyond the cement inlet. A fluid such as water is then pumped through the cement inlet to force the plug down the well pipe behind the cement slurry. Another "Cementing Plug Apparatus" is disclosed in U.S. Pat. No. 3,322,197, dated May 30, 1967, to E. E. Baker, et, al. The cementing plug apparatus detailed in this patent includes a plug release device having a sleeve which extends outwardly from the side of a plug container. A plunger is mounted in the sleeve and in its extended position, the plunger prevents a plug in the plug container from passing into the well pipe. In its retracted position, the plunger does not extend into the interior of the plug container, thus the plug is free to pass downwardly into the well pipe. The plunger is locked in extended position by a pair of dogs which are mounted in the sleeve and are movable into and out of a recess in the plunger. A cylindrical body is mounted on the exterior of the sleeve and a counterbore in one end of the body forms a cylinder for receiving a retainer piston which is mounted coaxially on the sleeve. The retainer piston blocks displacement of the dogs out of the plunger recess when the piston is retracted into the cylinder. The piston is urged into the cylinder by a spring. U.S. Pat. No. 3,444,928, dated May 20, 1969, to C. A. Pitts, discloses a "Plug Injector Apparatus" which is characterized by a cylindrically-shaped plug container having a hollow bore for receiving a pair of plugs, which plugs are enclosed in sleeves that drop into place and seat in alignment with the well pipe as the retainer elements are moved to the plug injection position. The plugs are seated on vertically oriented, rotatable rings which are manually rotated into registration with the plug circumference to allow the plugs to drop through the rings and into the well pipe. Other patents which detail cementing heads for releasing plugs into well pipe are noted as follows: U.S. Pat. No. 3,076,509, dated Feb. 5, 1963, entitled "Cementing Head", to E. Burns, et, al; U.S. Pat. No. 3,971,436, dated July 27, 1976, entitled "Cementing Head", to William T. Lee; U.S. Pat. No. 3,616,850, dated Nov. 2, 1971, entitled "Cementing Plug Launching Mandrel", to Lyle B. Scott; U.S. Pat. No. 3,507,325, dated Apr. 21, 1970, entitled "Well Cementing Apparatus", to L. B. Scott; U.S. Pat. No. 3,216,500, dated Nov. 9, 1965, entitled "Plug Injector Apparatus", to T. W. Diehl; U.S. Pat. No. 3,926,253, dated Dec. 16, 1975, entitled "Well Conduit Cementing Adaptor Tool", to John A. Duke; and U.S. Pat. No. 3,863,716, dated Feb. 4, 1975, entitled "Cementing Plug Release Assist Apparatus", to Steven G. Steich. U.S. Pat. No. 4,427,065, dated Jan. 24, 1984, to James S. Watson, discloses a cementing plug container and method of use. This container is characterized by a shaped housing containing one or more plugs, a plug release mechanism for each plug and a plug indicating mechanism for indicating when the plugs move through the saver sub or indicator module after being dropped by the plug release mechanisms.

It is an object of this invention to provide a new, improved and safe cementing plug container and remote control system which is characterized by at least one plug release mechanism that may be remotely or manually operated and serves to release one or more cementing plugs located in the container into the well pipe in a safe, positive and efficient manner without the necessity of removing the dome from the container.

Another object of this invention is to provide a cementing plug container and cementing plug indicating and injection system which is characterized by a plug pass indicator positioned beneath the plug release mechanism and provided with an internal drop bar which is contacted by the cementing plug or plugs as the cementing plugs pass sequentially through the housing to positively indicate, both at the well location and on a remotely positioned control panel, when the cementing plugs have passed from the housing through the cementing plug container bore.

Yet another object of the invention is to provide a new and improved cementing plug container and remote control system which includes a plug release mechanism for supporting and releasing one or more cementing plugs in the container housing and a cementing plug passage indicator device, which plug release mechanism is characterized by a separate air or hydraulic cylinder and a cooperating remotely located release valve for releasing each cementing plug in a specified and controlled sequence. This release is effected by extension of the air or hydraulic cylinder piston with a working fluid responsive to manipulation of the valve. Passage of the plugs through the cementing plug container is indicated by the plug pass indicator device which is positioned beneath the plug release mechanism or mechanisms and is secured to an indicator module mounted in the cementing plug container housing.

Still another object of this invention is to provide a cementing plug container and remote control system for injecting cementing plugs into the well pipe of an oil or gas well, wherein the cementing plug container is fitted with multiple, fluid-operated plug release devices and a plug pass indicating device which are linked to a remote control panel. A pair of lights, light-emitting diodes, or like signal or indicating means are mounted on the control panel, which signal means are electrically wired to a proximity sensor located in the plug pass indicating device to verify sequential passage of the cementing plugs from the container housing into the well pipe.

A still further object of this invention is to provide a new and improved, remotely-operated, fluid-actuated plug release mechanism for supporting and releasing one or more cementing plugs in a cementing plug container apparatus and cementing casing in oil and gas wells. The plug release mechanism includes a support arm for supporting the plugs and the support arm is attached to a release shaft which is carried by a release cam for maintaining the release arm in supporting configuration. The release cam further cooperates with an air or hydraulic cylinder designed to facilitate downward rotation of the release arm by extension of the cylinder piston to allow the cementing plugs to drop in sequence from the upper interior portion of the container housing into the indicator module portion of the container housing for injection into the well pipe. A remote control panel having a valve for pneumatic or hydraulic control of each air or hydraulic cylinder, respectively, in the plug release mechanism is used to operate the plug release mechanism from a remote and safe location outside of the immediate proximity of the cementing plug container.

Another object of the invention is to provide a positive and efficient, mechanically-operated cementing plug container indicator mechanism for determining when one or more cementing plugs have moved from the upper segment of a remotely-operated cementing plug container housing through the indicator module of the housing. The indicator device includes an indicator plate wheel rotatably positioned on a cam clutch carried by a shaft which also supports a drop bar located in the indicator module and extends into the path of the plug or plugs. The shaft rotatably projects through the indicator module and a return spring is secured to a bracket plate which is attached to the shaft for returning the drop bar to an extended position in the indicator module after rotation of the indicator plate wheel responsive to contact between the drop bar and a falling cementing plug. In a most preferred embodiment a proximity sensor located in the indicator mechanism is provided in electrical contact with indicator lights mounted on a remote control panel to indicate when the cementing plugs have sequentially exited the cementing plug container.

Yet another object of this invention is to provide a method for cementing casing in a well by remote control using a cementing plug container, which method includes the steps of providing the cementing plug container with at least one plug release mechanism and a plug indicating mechanism; providing a remote control panel fitted with control means linked in fluid cooperation to the plug release mechanism and in electrical association with the plug indicating mechanism; and operating the control means to manipulate the plug release mechanism and deposit cementing plugs in the well pipe.

Yet another object of this invention is to provide a method for depositing multiple plugs in the well pipe of a well by remote control using a cementing plug container having a removable dome, which method includes the steps of providing the cementing plug container with multiple fluid-operated plug release mechanisms oriented in stacked relationship in the cementing plug housing; locating multiple valves on a remote control panel distanced from the cementing plug container; linking the valves and plug release mechanisms with fluid conduits, respectively; providing an actuator in fluid cooperation with the cementing plug container and actuator control means located on the remote control panel and provided in fluid cooperation with the actuator for delivery of the fluid to the cementing plug container; and providing a plug pass indicator mechanism in the cementing plug container beneath the plug release mechanisms and establishing an electrical connection between the plug pass indicator mechanism and lights provided on the remote control panel to indicate when the plugs have passed from the cementing plug container into the well pipe responsive to operation of the valves and the actuator control means.

SUMMARY OF THE INVENTION

These and other objects of the invention are provided in a new and improved cementing plug container and method for injecting cementing plugs into the well pipe of an oil or gas well using a remote control apparatus. First operational elements in the cementing plug container include a plug release mechanism for each cementing plug, which plug release mechanisms are designed to support and selectively release multiple cementing plugs in the housing. Each cementing plug release mechanism further includes a plug release arm for supporting a cementing plug and the cementing plugs are normally inserted in stacked relationship in an upper segment of the housing. A shaft carrying the plug release arm at one end extends through the housing and is attached to a release cam at the opposite end. A cam lock mechanism is provided in cooperation with an air or hydraulic cylinder and the release cam, whereby energizing of the air or hydraulic cylinder by activation of an air or hydraulic cylinder valve mounted on a control panel effects linear movement of the cam lock mechanism and rotation of the release cam and the support arm to permit each cementing plug to drop in sequence from an initial position in the upper part of the container housing into the housing bore for injection into the well pipe. A plug pass indicator is characterized by a rotating indicator plate wheel positioned outside the cementing plug container housing beneath the plug release mechanism or mechanisms. The indicator plate wheel is carried by a cam clutch mounted on a rotatable shaft which extends through the housing and carries a drop arm which projects into the indicator module bore. The wheel is rotated one-quarter turn responsive to movement of each cementing plug through the housing and indicator module bore as each cementing plug contacts the drop bar and rotates the shaft. A remote control panel is provided with air or hydraulic cylinder valves, an actuator valve, air or hydraulic cylinder supply lines, fittings and a source of electricity such as a battery, as well as indicator lights for pneumatic or hydraulic control of the plug release mechanism at a distance. A proximity sensor located in the plug pass indicator device is electrically connected to indicator lights located in the control panel to remotely indicate when the cementing plugs have exited the cementing plug container.

A method for depositing plugs into a well pipe by remote control using a cementing plug container having a removable dome, which method includes the steps of providing the cementing plug container with at least one plug release mechanism and a plug indicating mechanism; providing a remote control panel with appropriate controls for intorducing fluid into the cementing plug container and operating the plug release mechanism at a distance; and further providing indicating or signal indicia mounted on the remote control panel and associated with the plug indicating mechanism for determining when a cementing plug or plugs exit the cementing plug container and are injected into the well pipe responsive to manipulation of the controls.

BRIEF DESCRIPTION OF THE DRAWINGS

The invention will be better understood by reference to the accompanying drawings wherein.

DESCRIPTION OF THE PREFERRED EMBODIMENTS

Figure 1:
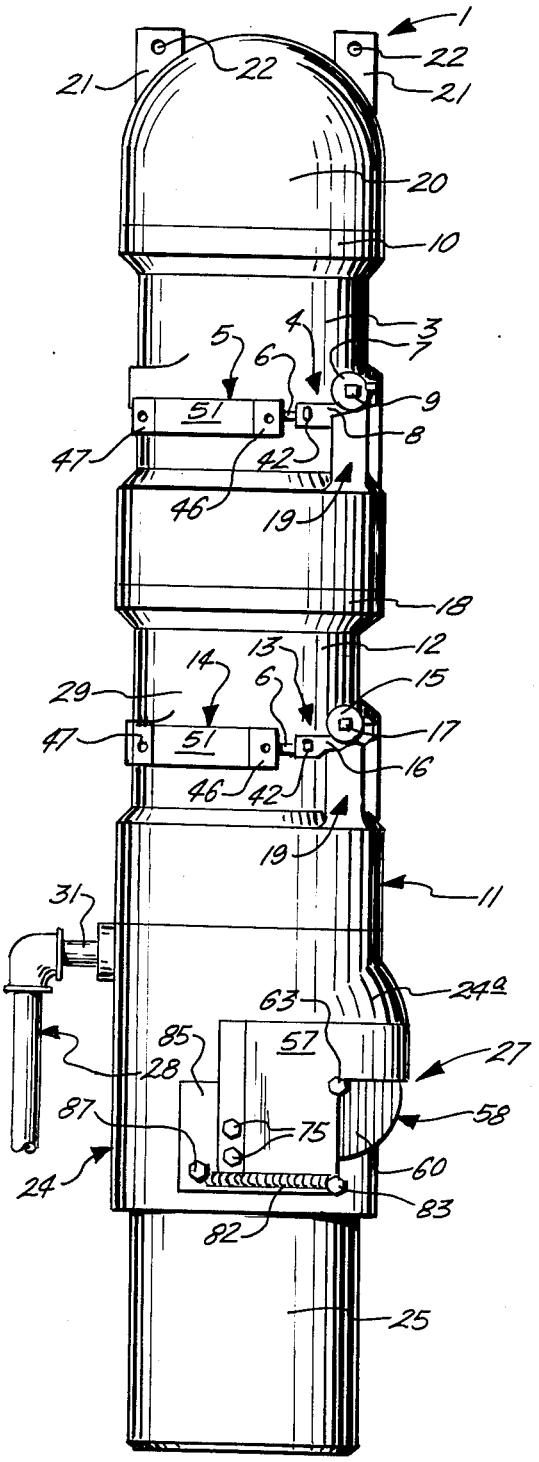
FIG. 1 is a front elevation of a first preferred embodiment of the cementing plug container of this invention, more particularly illustrating external elements of the plug release mechanisms and the plug pass indicator mechanism.
Figure 2:
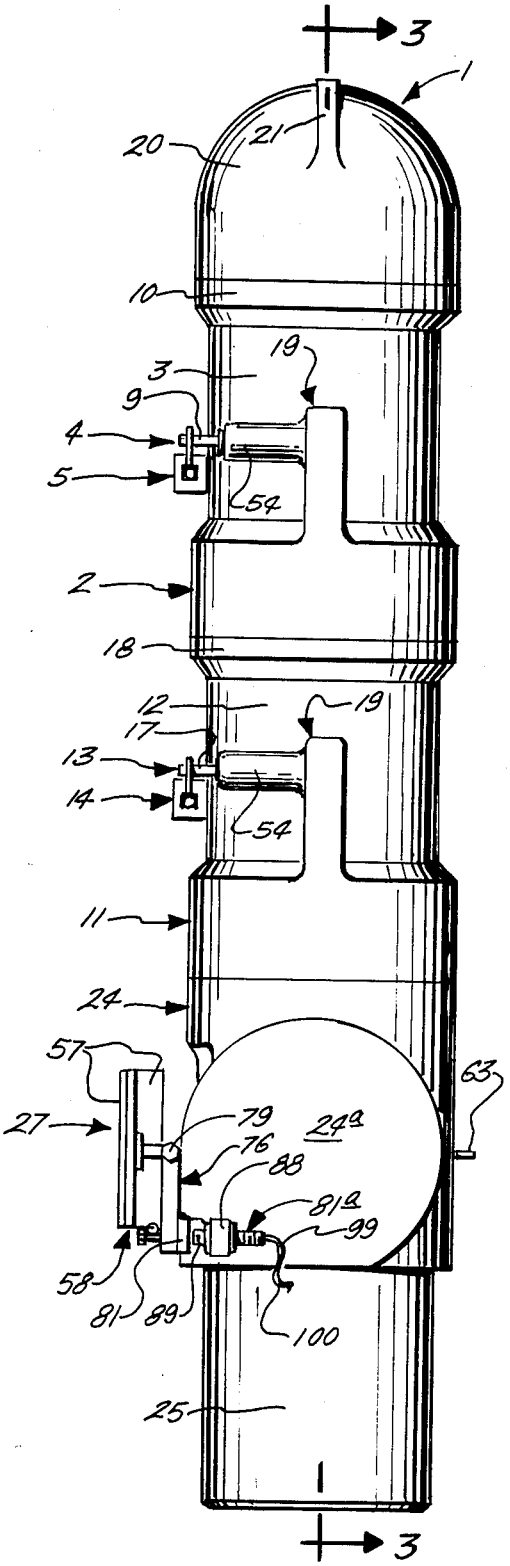
FIG. 2 is a right side elevation of the cementing plug container illustrated in FIG. 1.
Figure 3:
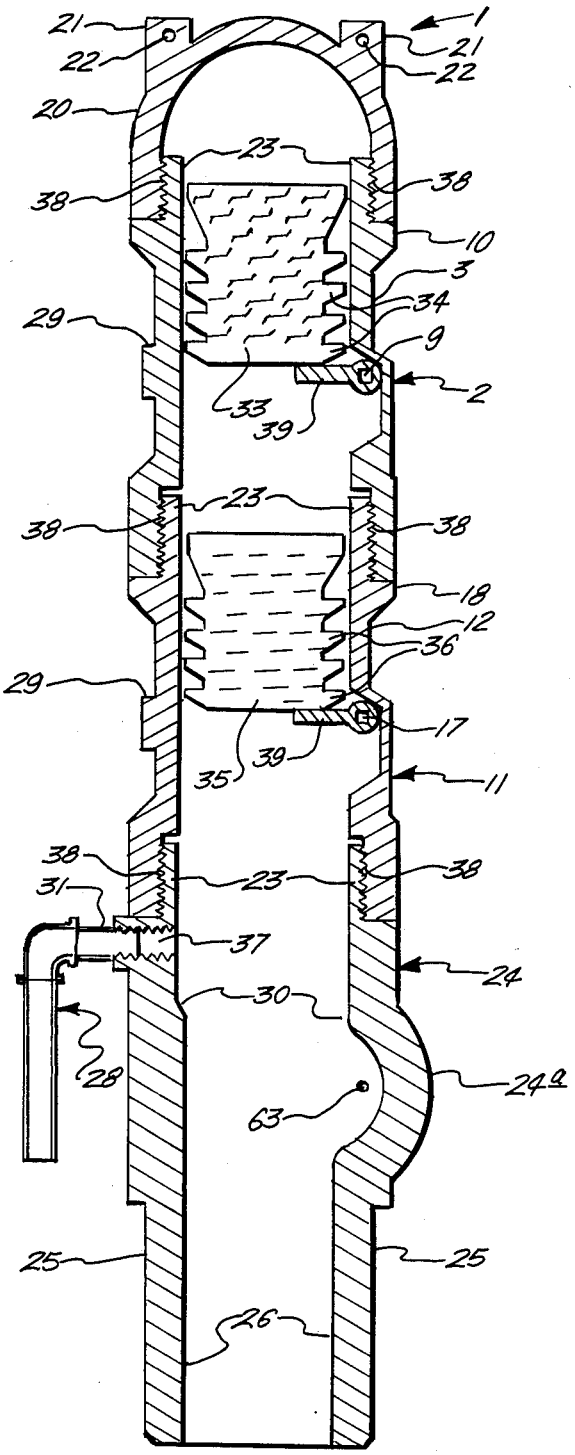
FIG. 3 is a sectional view taken along line 3—3 of the cementing plug container illustrated in FIG. 2.

Referring now to FIGS. 1–3 of the drawings, in a preferred embodiment the cementing plug container of this invention is generally illustrated by reference numeral 1 and includes a dome 20, an upper housing 2 and lower housing 11 and an indicator module 24 extending from the lower housing 11. A top plug chamber 3 and a bottom plug chamber 12 accommodate a pair of cementing plugs, identified as a top plug 33 and bottom plug 35 in FIG. 3, in the hollow interior of the cementing plug container 1 and the dome 20 is provided with a pair of dome flanges 21, fitted with flange apertures 22, for lifting purposes. The upper housing 2 and lower housing 11 are also fitted with inlet castings 29 for introducing cement into the top plug chamber 3 and bottom plug chamber 12, if desired, and a manifold assembly 28, fitted with an indicator module inlet 31, is provided for introducing fluid into the interior of the indicator module 24.

A bottom plug release is generally illustrated by reference numeral 13 and the external component parts of the bottom plug release 13 are mounted on a shaft housing 19 in the lower housing 11, as illustrated in FIG. 2. Among the exterior component parts of the bottom plug release 13 is the bottom cylinder 14, which is characterized by a cylinder piston housing 51 having a front base 46 and a rear base 47, as illustrated. The cylinder piston rod 6 of the bottom cylinder 14 cooperates with a bottom cam lock 16 to slide the bottom cam lock 16 forward with respect to a cam lock release pin 42 and release the bottom plug release cam 15 to drop the bottom plug 35 to the mouth 30 of the indicator module bore 26, as hereinafter described. A top plug release is generally illustrated by reference numeral 4 and is positioned above the bottom plug release 13 on a shaft housing 19, located in the upper housing 2. A top cylinder 5, also having a front base 46 and a rear base 47 connected by a cylinder piston housing 51, is provided with a cylinder piston rod 6 in cooperation with a top cam lock 8 and a cooperating top plug release cam 7. Accordingly, it will be appreciated that energizing of the top cylinder 5 releases the top cam lock 8 from the top plug release cam 7 and allows the top plug 33 to drop from the top plug chamber 3 to the mouth 30 of the indicator module bore 26 after release of the bottom plug 35, as hereinafter described.

As further illustrated in FIGS. 1 and 2 of the drawings, a plug pass indicator, generally illustrated by reference numeral 27, is positioned beneath the bottom plug release 13. In a preferred embodiment of the invention the plug pass indicator 27 is mounted to the indicator module 24 and is designed to indicate when the top plug 33 and bottom plug 35, located in the interior of the plug chamber bore 23 of the upper housing 2 and lower housing 11, respectively, are released from the top plug release 4 and the bottom plug release 13. The well pipe connector 25 which extends from the indicator module 24 is designed to be threaded and attached to the well pipe (not illustrated) in an existing oil or gas well.

Referring again to FIG. 3 of the drawings the cementing plug container 1 is characterized by a hollow interior which is shaped to define a plug chamber bore 23 in the interior of the top plug chamber 3 and bottom plug chamber 12, respectively. In a preferred embodiment of the invention the dome 20 is threadibly attached to the upper housing 2 by means of housing threads 38 and rests on an upper housing shoulder 10 of the upper housing 2. Similarly, the upper housing 2 is attached to the lower housing 11 and rests on a lower housing shoulder 18 and the lower housing 11 is connected to the indicator module 24, respectively, by means of additional housing threads 38. Should entry of fluids into the plug chamber bore 23 be desired, the inlet castings 29 can be drilled and tapped and inlet lines added to the manifold assembly 28, as deemed necessary.

Referring again to FIGS. 1–3, it will be appreciated that the top plug release shaft 9 of the top plug release 4 and the bottom plug release shaft 17 of the bottom plug release 13 each extend through a separate shaft housing 19, respectively, and carry a plug release arm 39, disposed in the top plug chamber 3 and bottom plug chamber 12, respectively. Accordingly, as hereinafter more particularly described, when the top cylinder 5 and bottom cylinder 14 are energized in the proper sequence, each of the respective companion plug release arms 39 are caused to rotate downwardly and sequentially release the top plug 33 and the bottom plug 35, respectively, resting on the plug release arms 39, at the appropriate time. The top plug 33 and bottom plug 35 then drop to the mouth 30 of the indicator module bore 26, which is smaller in diameter than the plug chamber bore 23 and the projecting top plug ribs 34 and bottom plug ribs 36, respectively. Accordingly, both the top plug 33 and bottom plug 35 remain in contact with the top portion or mouth 30 of the indicator module bore 26 until they are forced through the indicator module bore 26 and into the well pipe (not illustrated) by cement or other fluid pressure, as hereinafter described.

Figure 4:
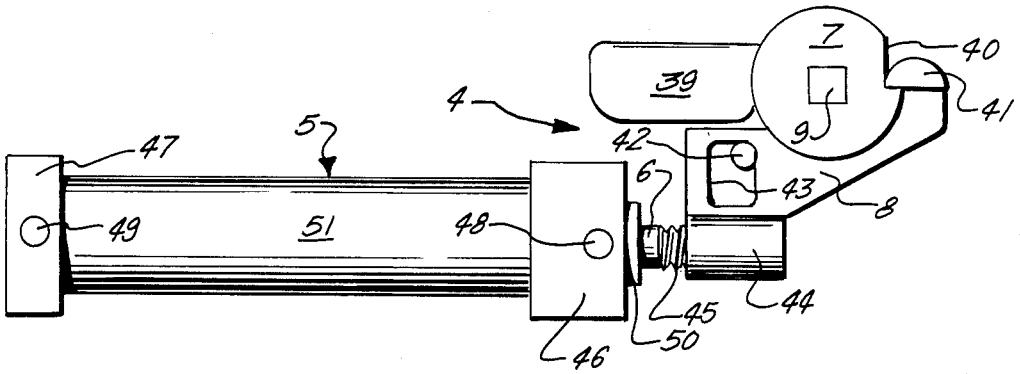
FIG. 4 is a front elevation, partially in section, of one of the plug release mechanisms illustrated in FIG. 1.
Figure 5:
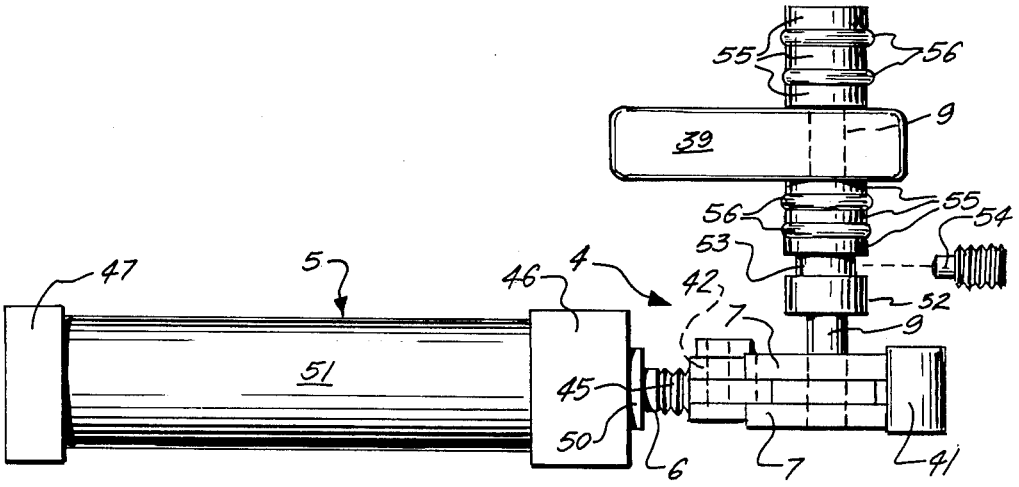
FIG. 5 is a top elevation of the plug release mechanism illustrated in FIG. 4.
Figure 6:
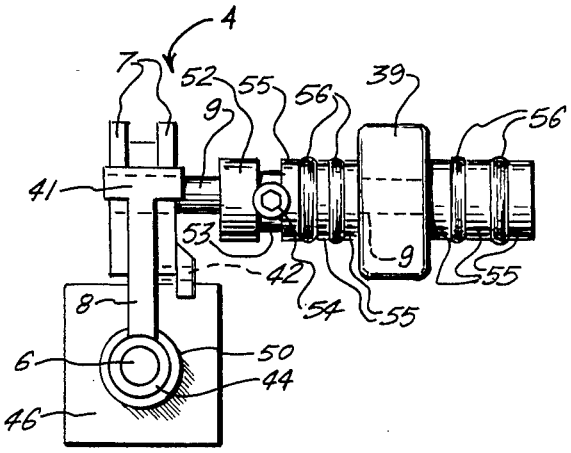
FIG. 6 is a right end elevation of the plug release mechanism illustrated in FIGS. 4 and 5.
Figure 7:
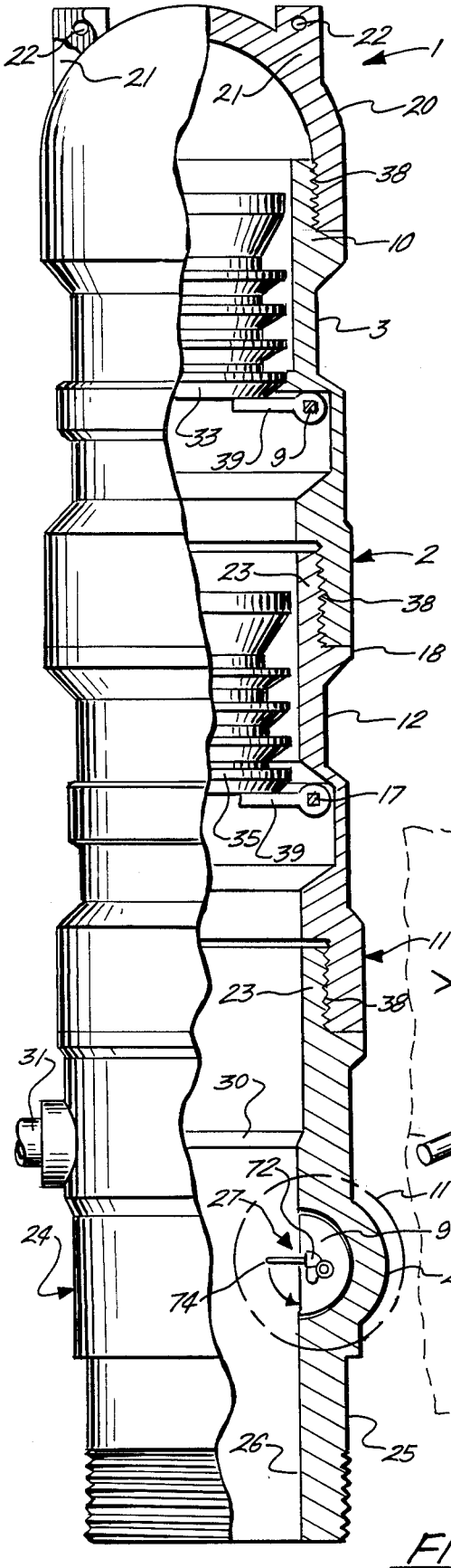
FIG. 7 is a perspective view, partially in section, of the cementing plug container illustrated in FIG. 1, with a pair of cementing plugs loaded in the cementing plug container.

As illustrated in FIGS. 1–3, 4, 5 and 6 of the drawings, FIGS. 4–6 of which illustrate the top plug release 4 in detail, it will be appreciated that the top plug release 4 and bottom plug release 13 are identical in mechanical configuration and function. Referring specifically to FIGS. 5 and 6, as heretofore described, the top plug release shaft 9, which carries the top plug release cam 7, rotatably extends through a shaft housing 19, with the plug release arm 39 projecting through the upper housing 2 and into the top plug chamber 3. Accordingly, the top cylinder 5 and its companion cylinder piston rod 6, provided with piston rod threads 45; the piston seal 50, as well as the top plug release cam 7; the top cam lock 8 and cooperating cam lock finger 41; and the cam lock base 44, to which the cylinder piston rod 6 is threadably secured, are all positioned outside of the upper housing 2. Furthermore, the O-ring shoulders 55, which contain a pair of spaced O-rings 56 and the end of the top plug release shaft 9 located opposite the top plug release cam 7, extend inside the shaft housing 19, with a set screw 54 threadably inserted in the wall of the shaft housing 19 and engaging a set screw release groove 53 provided in the release shaft collar 52, to secure the O-ring shoulders 55 and the O-rings 56 in rotatable relationship inside the shaft housing 19. Accordingly, it will be appreicated that since the top plug release shaft 9 is secured to the top plug release cam 7 at one end and since the O-ring shoulders 55 are rotatably located inside the shaft housing 19, the companion plug release arm 39 is free to rotate with the top plug release shaft 9 upon rotation of the plug release cam 7. Referring to FIG. 4, it will be further appreciated that the top cylinder 5 can be energized by injecting air or hydraulic fluid, as appropriate, into the cylinder piston housing 51 through a rear base aperture 49 provided in the rear base 47. This fluid introduction expels air from a front base aperture 48 in the front base 46 and compresses a spring (not illustrated) located in the cylinder piston housing 51, to extend the cylinder piston rod 6 and slidably displace the top cam lock 8 on the cam lock release pin 42, due to the width of the cam lock aperture 43 provided in the top cam lock 8. This forward motion of the top cam lock 8 with respect to the cam lock release pin 42 disengages the cam lock finger 41 from a companion cam slot 40, provided in the top plug release cam 7. Further extension of the cylinder piston rod 6 exerts pressure on the cam lock release pin 42, which is attached to the top plug release cam 7 and causes the top plug release cam 7 and the plug release arm 39 to rotate in the counter-clockwise direction. Rotation of the plug release arm 39 allows the top plug 33 to fall from its position inside the top plug chamber 3 to the mouth 30 of the indicator module bore 26. It will be appreciated that prior to activation of the top plug release 4, the bottom plug 35 would have been previously released from its position on the bottom plug release arm 39 responsive to activation of the bottom cylinder 14 in the manner described above with respect to the top cylinder 5. The cylinder piston rod 6 is retracted by reducing the fluid pressure to the rear base aperture 49 and allowing the spring-loaded top cylinder 5 to retract into the configuration illustrated in FIGS. 4 and 5, as hereinafter described.

Figure 8:
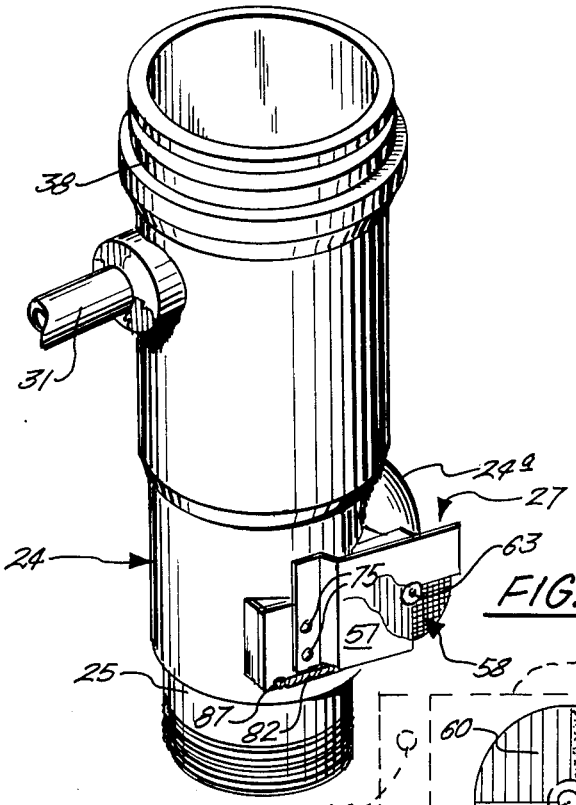
FIG. 8 is a perspective view of the indicator module element of the cementing plug container illustrated in FIG. 7, more particularly illustrating the plug pass indicator.
Figure 9:
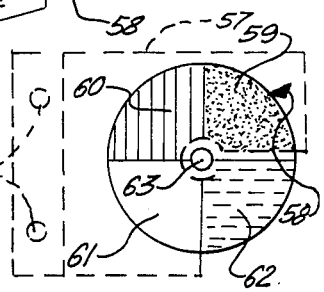
FIG. 9 is a front elevation of the indicator plate wheel element of the plug pass indicator illustrated in FIG. 8.
Figure 10:
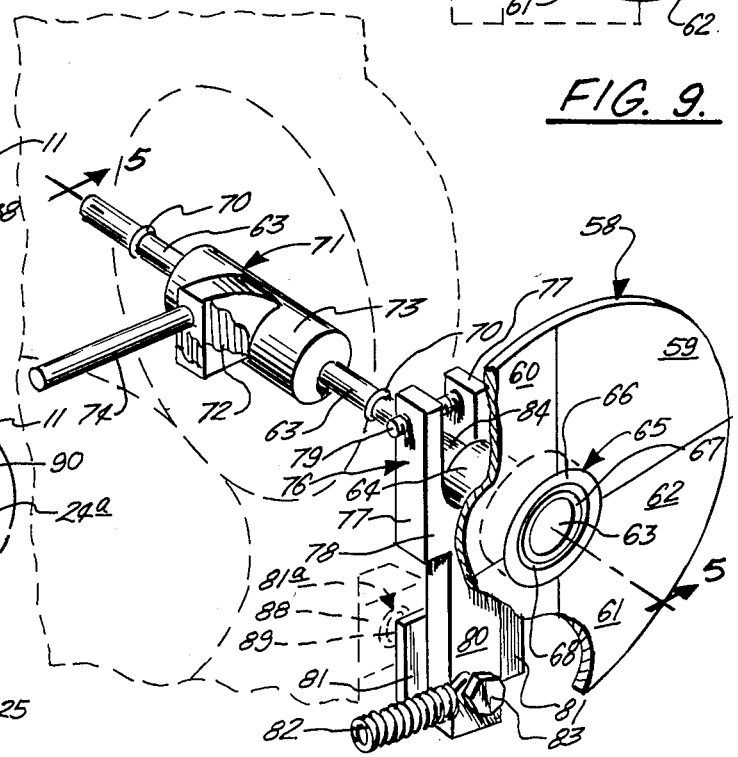
FIG. 10 is an exploded view of the plug pass indicator illustrated in FIG. 8.

Referring now to FIGS. 1, 2 and 7–9 of the drawings the plug pass indicator is generally illustrated by reference numeral 27 and is mounted in the indicator module 24 adjacent to the enlargement **24*a*. External elements of the plug pass indicator 27 include a flat mount plate 85, which is bolted to a mount plate base 86, mounted on the indicator module 24 and a proximity sensor 81*a*, attached to the mount plate 85 and provided with a sensor head 89, as illustrated in FIG. 2. An indicator plate 57 is attached to the mount plate 85 by means of two plate mount bolts 75, which register with indicator plate apertures 69 located in the indicator plate 57 and with cooperating threaded apertures (not illustrated) provided in the mount plate 85. As illustrated in FIGS. 9 and 10, an indicator plate wheel 58 is visible through a window provided in the indicator plate 57 and the indicator plate wheel 58 is divided into quadrants which are color-coded. As illustrated in FIG. 9, the quadrants are provided with different colors as follows: A black panel 59 is provided in one quadrant a red panel 60 in the adjacent quadrant, a white panel 61 is provided in the next successive quadrant and a yellow panel 62** marks the fourth, and last quadrant.

Referring now to FIGS. 7–11, in a preferred embodiment of the invention the indicator plate wheel 58 is attached to the indicator module 24 by means of a shaft 63, a portion of which shaft 63 extends inside the indicator module bore 26 and is rotatably sealed across the curved wall of the enlargement 24a in the indicator module 24, by means of a pair of shaft O-rings 70. The drop arm 74 extends from an arm base 72, which is attached to an enlarged shaft collar 73, provided on the shaft 63. The drop arm bracket 71, which includes the shaft collar 73, the arm base 72 and the drop arm 74, is located inside the indicator module bore 26 in the enlarged bore cavity 90 shaped by the enlargement 24a. As illustrated in FIG. 10, a square collar enlargement 84 is positioned on that portion of the shaft 63 which extends outside the indicator module 24 and the inner race 67 of a cam clutch 65 is tightly secured to the projecting end of the shaft 63 against a clutch collar 64, extending from the collar enlargement 84. The outer race 66 of the cam clutch 65 is secured to the indicator plate wheel 58. A ball track 68 is positioned between the inner race 67 and the outer race 66 and carries several ball bearings and cams (not illustrated), which cams allow the indicator plate wheel 58 and the outer race 66 to rotate in the counter-clockwise direction when viewing the indicator plate wheel 58 from the front. However, while the shaft 63, the clutch collar 64 and the inner race 67 are free to rotate in the clockwise direction, the indicator plate wheel 58 and the outer race 66 are maintained in the counter-clockwise rotated position, as hereinafter described. In a preferred embodiment of the invention the cam clutch 65 used in the plug pass indicator 27 is a model KK-17 cam clutch sold under the "Morse" trademark.

Figure 11:
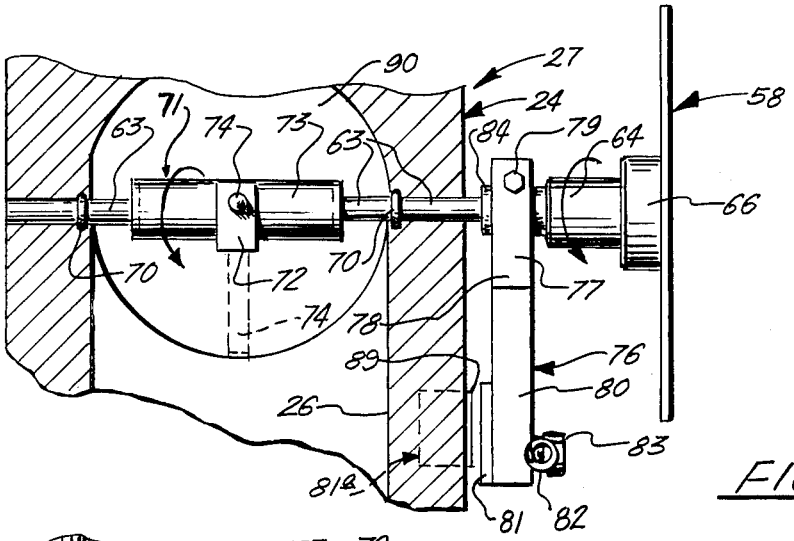
FIG. 11 is a side sectional view of the plug pass indicator illustrated in FIG. 8, with the plug pass indicator positioned in functional orientation in the indicator module.

As illustrated in FIGS. 10 and 11 of the drawings, the collar enlargement 84 is disposed on the shaft 63 between the collar bracket legs 77 of a collar bracket 76 and the collar bracket legs 77 are secured in this position by means of a collar bracket bolt 79, which is threaded in one of the collar bracket legs 77. A collar bracket base 78 supports the collar bracket legs 77 and one end of a return spring 82 is secured to the projecting end of the collar bracket neck 80 by means of a neck bolt 83, which collar bracket neck 80 extends the collar bracket base 78. As illustrated in FIG. 8, the opposite end of the return spring 82 is seucred to the mount plate 85 by means of a mount plate bolt 87. A sensor plate 81 is secured to the collar bracket neck 80 and is positioned directly adjacent to, but spaced from the sensor head 89 of the proximity sensor **81*a*, which is attached to a sensor bracket 88, extending from the mount plate 85**.

Figure 15:
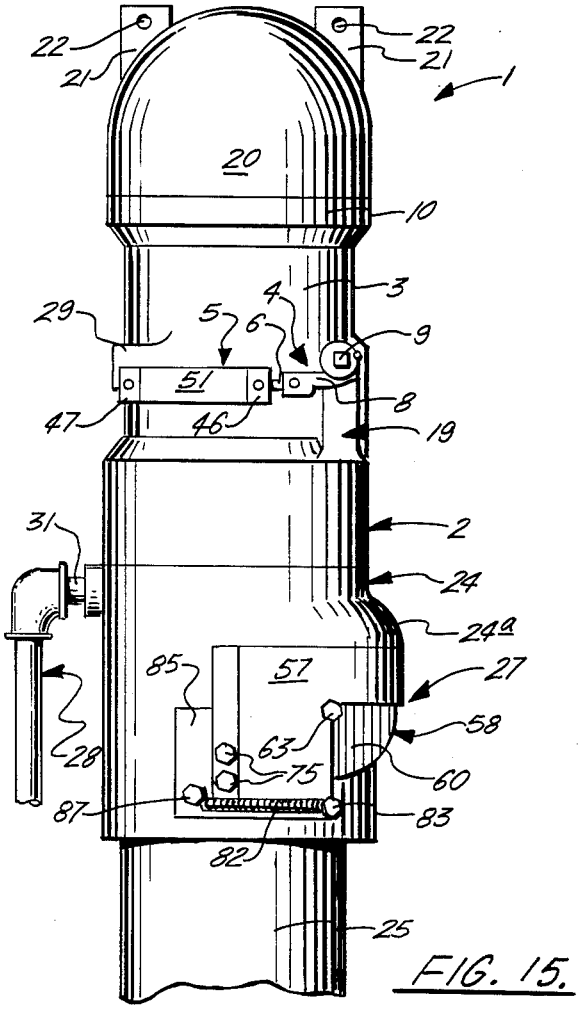
FIG. 15 is a front elevation of an alternative preferred embodiment of the cementing plug container of this invention.
Figure 16:
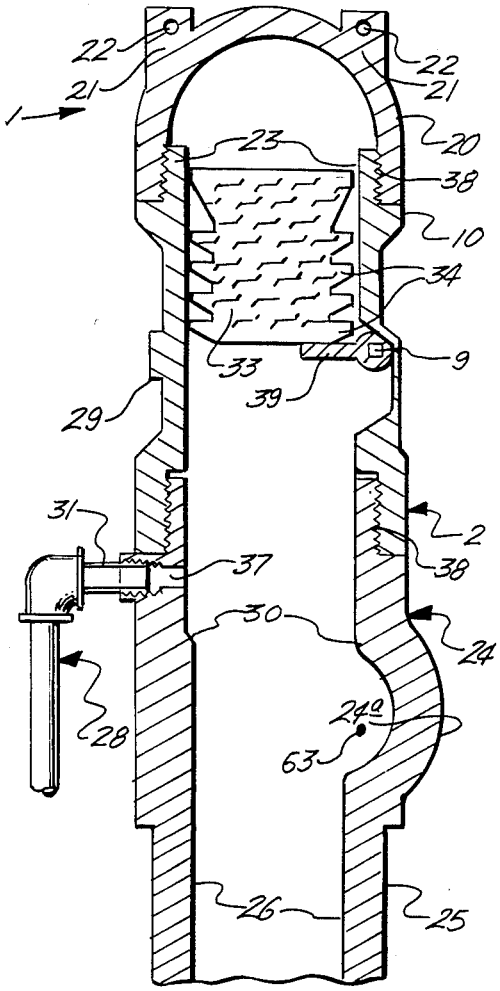
FIG. 16 is a front sectional view of the cementing plug container illustrated in FIG. 15.

Referring now to FIGS. 15 and 16 of the drawings, in an alternative preferred embodiment of the invention the cementing plug container 1 consists of a dome 20, threadably secured to an upper housing 2 by means of housing threads 38 and an indicator module 24, also connected by means of housing threads 38 directly to the upper housing 2. In this embodiment of the invention the lower housing 11, illustrated in FIGS. 1 and 2, is eliminated under circumstances where a single top plug 33 is provided in the cementing plug container 1 and is used to clean cement residue from the well pipe. A plug pass indicator 27 is provided in the indicator module 24, as described above, with the drop arm bracket 71 located in the bore cavity 90 as illustrated, in order to indicate the passage of the top plug 33 through the indicator module bore 26, as heretofore described.

Figure 17:
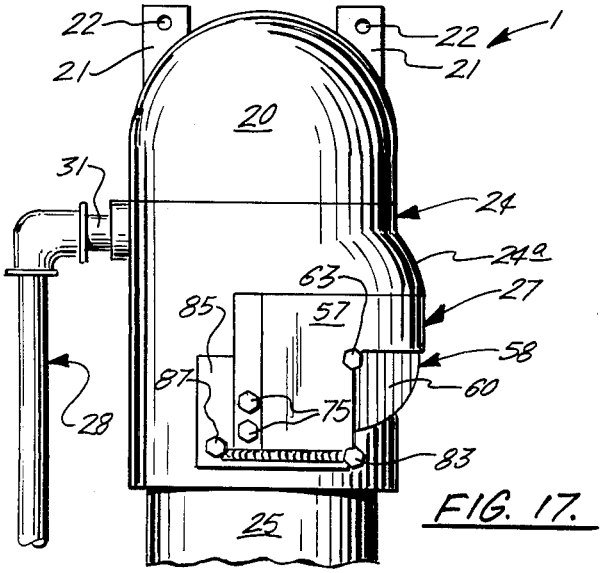
FIG. 17 is a front elevation of yet another preferred embodiment of the cementing plug container of this invention.
Figure 18:
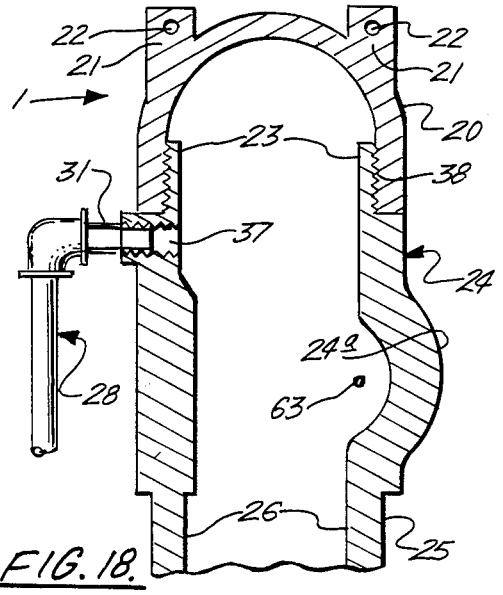
FIG. 18 is a front sectional view of the cementing plug container illustrated in FIG. 17.

Referring to FIGS. 17 and 18, in a still further preferred embodiment of the invention the dome 20 can be directly and threadably attached to the indicator module 24 by means of housing threads 38, with a plug pass indicator 27 provided in the indicator module 24, as heretofore described. In this embodiment of the invention, no cementing plugs are inserted inside the dome 20 and the cementing plug container 1 is simply used to inject fluids into the well, as desired. Furthermore, the plug pass indicator 27 is provided in the indicator module 24 simply to demonstrate the versatility of interchanging parts in the cementing plug container 1.

Figure 19:
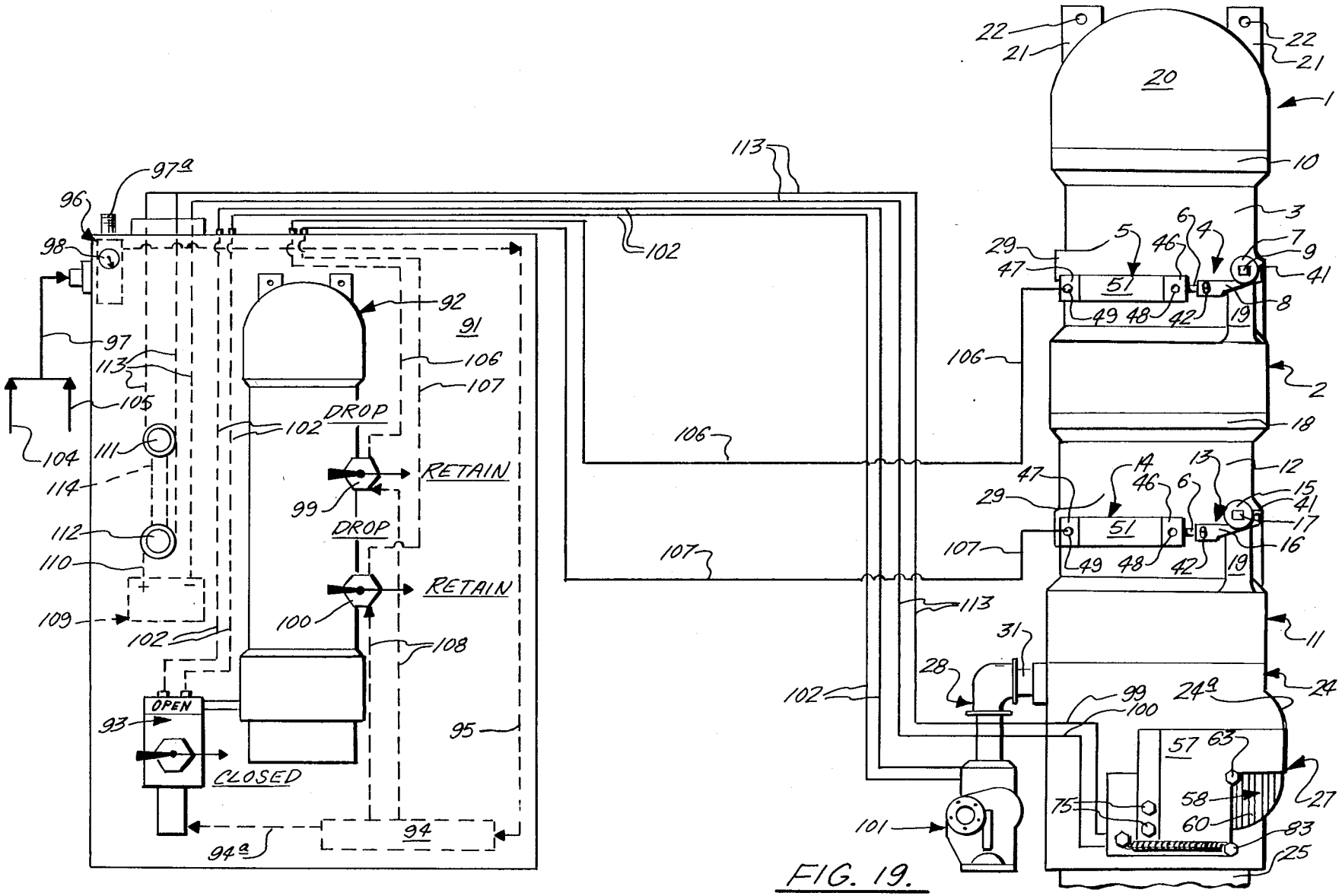
FIG. 19 is a front elevation of the cementing plug container illustrated in FIG. 1 provided in electrical and pneumatic or hydraulic connection to a remote control panel.

Referring now to FIG. 19 of the drawings in another preferred embodiment of the invention the cementing plug container 1 is operated by controls located on a control panel 91, which can be removed from the immediate vicinity of the cementing plug container 1 and the well to reduce the danger of operating the cementing plug container 1. In a most preferred embodiment the control panel 91 is provided with an outline 92 of the cementing plug container 1 and an actuator valve 93 serves to selectively admit compressed air or hydraulic fluid through the actuator 101 and indicator module inlet 31, into the indicator module 24 of the cementing plug container 1, as hereinafter described. It will be appreciated that the valving and operation of the cementing plug container 1 can be achieved by using many fluids known to those skilled in the art, including gases, such as compressed air and nitrogen, and liquids, such as oil and hydraulic fluid, in non-exclusive particular. Accordingly, a fluid such as compressed air is supplied to the actuator valve 93 from a supply manifold 94, through an actuator valve intake line **94*a*. The fluid flows into the manifold 94 through a manifold intake line 95 and a pressure regulator 96, from a fluid intake line 97 and is controlled by a fluid inlet control knob 97*a* by monitoring a fluid pressure gauge 98. Various fluids such as compressed air and hydraulic fluid can be injected into the system through an air supply line 104 and a hydraulic fluid supply line 105, depending upon the selected design of the pressure regulator 96, actuator 101, actuator valve 93, top cylinder valve 99, top cylinder 5, bottom cylinder valve 100 and bottom cylinder 14. Accordingly, it will be recognized that the pressure regulator 96 can be characterized as either a hydraulic or an air-operated regulator to accommodate the chosen working fluid in the system, according to the knowledge of those skilled in the art. The top cylinder valve 99 is provided on the control panel 91 in pneumatic or hydraulic cooperation with the top cylinder 5 by means of a top valve discharge line 106, which extends from the top cylinder valve 99 to connect in the rear base aperture 49 of the rear base 47 located in the top cylinder 5 and the appropriate working fluid is supplied to the top cylinder 5 on demand from the top cylinder valve 99. Similarly, a bottom cylinder valve 100 is provided on the control panel 91 at the appropriate point on the outline 92 and is in pneumatic or hydraulic cooperation with the bottom cylinder 14 in the cementing plug container 1 by means of a bottom valve discharge line 107, which connects to the rear base aperture 49 of the rear base 47 in the bottom cylinder 14. The selected working fluid is supplied to both the top cylinder valve 99 and the bottom cylinder valve 100 through cylinder valve intake lines 108, which communicate with the manifold 94. In yet another most preferred embodiment of the invention a battery 109 is provided in the control panel 91 and battery wiring 110 is extended from one terminal of the battery 109 to a bottom plug light 112, which is wired in series with the battery 109 and with a top plug light 111, by means of plug light wiring 113. The plug light wiring 113 is also connected to the proximity sensor 81*a*, as illustrated in FIG. 2, in order to illuminate the top plug light 111 and bottom plug light 112 in sequence, upon operation of the plug pass indicator 27. In a most preferred embodiment of the invention a circuit board 114 is mounted on the control panel 91 and is fitted with an electronic circuit that is electrically connected to the plug light wiring 113. The circuit board 114 is designed to facilitate operation of the bottom plug light 112 and top plug light 111, as well as any other plug lights which may be provided in the control panel 91, in sequence from bottom to top, as the proximity sensor 81*a* operates responsive to passage of the bottom plug 35, top plug 33 and other plugs through the indicator module bore 26**, as hereinafter described.

In operation, and referring again to FIGS. 1–3 and 19 of the drawings, under circumstances where the cementing plug container 1 is characterized by a dome 20, an upper housing 2, a lower housing 11 and an indicator module 24, the cementing plug container 1 can be used to inject a top plug 33 and a bottom plug 35 into a well pipe as follows. The well pipe connector 25 is initially threaded and prepared for connection to an existing oil or gas well according to procedures known to those skilled in the art. After the cementing plug container 1 has been connected to the well head, the plug light wiring 113 and battery wiring 110 are connected to the top plug light 111 and bottom plug light 112 and wired to the proximity sensor **81*a* and the battery 109, as heretofore described. The top valve discharge line 106 is then extended from the top cylinder valve 99 to a connection in the rear base aperture 49 of the top cylinder 5 and the bottom valve discharge line 107 is extended from the bottom cylinder valve 100 to a connection in the rear base aperture 49 of the bottom cylinder 14, to pneumatically or hydraulically connect the cementing plug container 1 to the control panel 91, depending upon the design choice of the actuator 101, actuator valve 93, top cylinder valve 99, top cylinder 5, bottom cylinder valve 100 and bottom cylinder 14. The actuator fluid lines 102 are then installed between the actuator valve 93 and the actuator 101. A compressor or hydraulic fluid pump (not illustrated) is subsequently activated to supply the chosen working fluid to the pressure regulator 96 and supply manifold 94 through the fluid inlet line 97. The dome 20 is subsequently removed from the upper housing 2, the upper plug release arm 39 is rotated downwardly by manipulation of the top cylinder valve 99 from the "RETAIN" position to the "DROP" position in order to energize the top cylinder 5 and the bottom plug 35 is placed on the lower plug release arm 39 in the bottom plug chamber 12 of the lower housing 11, as illustrated in FIG. 3. Subsequently, the upper plug release arm 39 is rotated upwardly by returning the top cylinder valve 99 to the "RETAIN" position and a top plug 33 is placed in position on the upper plug release arm 39. The dome 20 is then threadably replaced on the upper housing 2 and is secured tightly on the housing threads 38 against the upper housing shoulder 10 and the cementing plug container 1 is ready for operation. Alternatively, the cementing plug container 1 can be pre-loaded with the top plug 33 and a bottom plug 35**, as desired. When it is desired to begin pumping cement through the cementing plug container 1 and into the well pipe, the bottom plug release 13 is activated by manipulating the bottom cylinder valve 100 from the "RETAIN" to the "DROP" position and compressed air or hydraulic fluid is charged through the bottom valve discharge line 107 to energize the bottom cylinder 14 and extend the companion cylinder piston rod 6. This action also extends the bottom cam lock 16 and cam lock finger 41, which are attached to the cylinder piston rod 6, as illustrated in FIGS. 4–6, to release the cam lock finger 41 from the cam slot 40 of the bottom plug release cam 15, as heretofore described. The bottom plug release cam 15 and companion plug release arm 39 then rotate in the counter-clockwise direction responsive to further extension of the cylinder piston rod 6, causing the bottom plug 35 to drop to the mouth 30 of the indicator module bore 26, where the bottom plug ribs 36 of the bottom plug 35 contact the mouth 30 of the indicator module bore 26 and prevent the bottom plug 35 from moving further downwardly. The actuator valve 93 is then manipulated from the "CLOSED" to the "OPEN" position to allow working fluid to flow through one of the actuator fluid lines 102 and open the actuator 101. Cement or any alternative fluid is then pumped through the actuator 101 and indicator module inlet 31 and into the indicator module 24 through the indicator module inlet 31 of the manifold assembly 28 to secure the well pipe in the well bore and the pressure of the appropriate fluid forces the bottom plug 35 through the indicator module bore 26 and the well pipe to precede the cement into the well pipe. When it is desired to clear the well pipe of residual cement, the top plug release 4 is operated by manipulating the top cylinder valve 99 from the "RETAIN" to the "DROP" configuration, in order to energize the top cylinder 5, extend the companion cylinder piston rod 6 and release the top plug release cam 7 from the cooperating cam lock finger 41, as heretofore described with regard to the bottom plug release 13. Further extension of the cylinder piston rod 6 causes the top plug release cam 7 to rotate in the counter-clockwise direction and moves the upper plug release arm 39 downwardly, causing the top plug 33 to fall to the mouth 30 of the indicator module bore 26. A displacing fluid such as drilling mud, in non-exclusive particular, is then introduced into the actuator 101 and indicator module inlet 31 to force the top plug 33 through the indicator module bore 26 and into the well pipe. As illustrated in FIGS. 1 and 8 of the drawings, in a most preferred embodiment of the invention the indicator module inlet 31 is attached to the indicator module 31 at a tangent instead of at the diameter of the indicator module 31 cross-section. This mechanical arrangement assures the production of a vortex or tornado fluid flow inside the indicator module bore 26 and the resulting vacuum, coupled with the fluid pressure exerted on the plug from above, forces the bottom plug 35 and top plug 33 through the indicator module bore 26.

Figure 12:
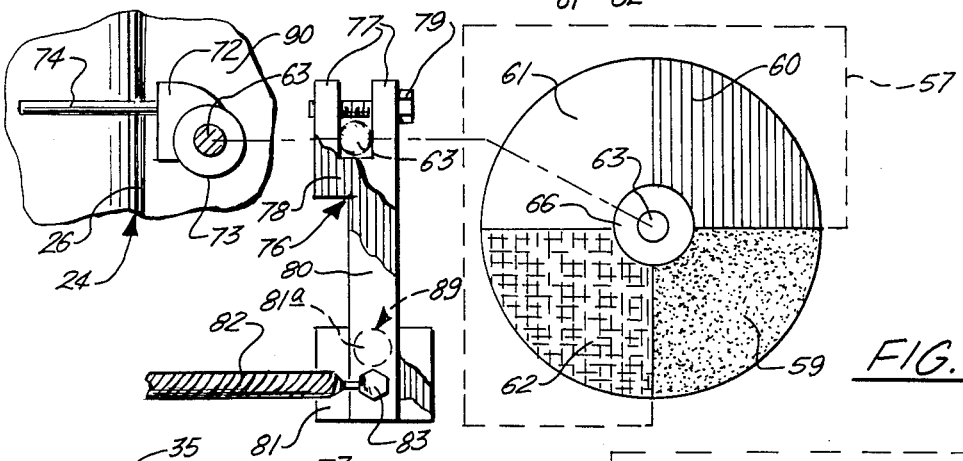
FIG. 12 is an exploded view of the plug pass indicator illustrated in FIG. 8, more particularly illustrating the relative positions of the drop bar, collar bracket and indicator plate wheel before a cementing plug contacts the drop bar.
Figure 13:
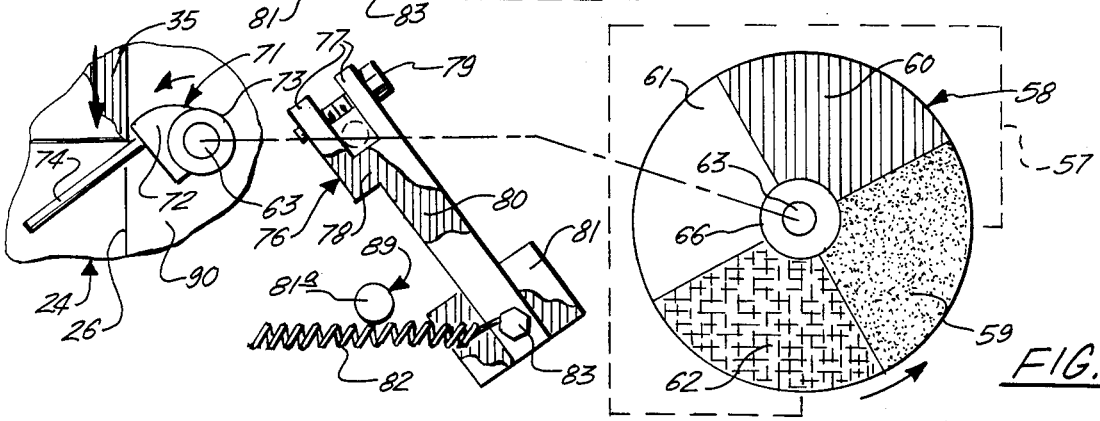
FIG. 13 is an exploded progress view of the plug pass indicator illustrated in FIG. 12, more particularly illustrating relative movement of the drop bar, collar bracket and indicator plate wheel when a cementing plug contacts the drop bar.
Figure 14:
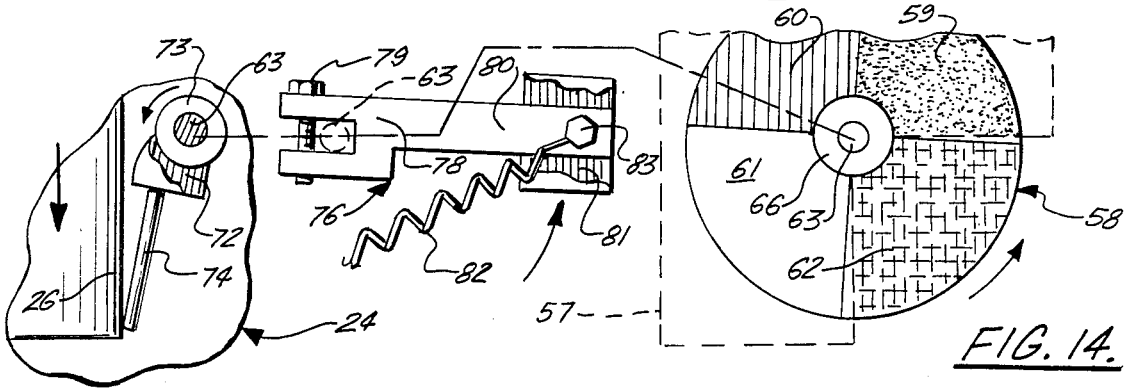
FIG. 14 is an exploded progress view of the plug pass indicator illustrated in FIGS. 12 and 13, illustrating further relative movement of the drop bar, collar bracket and indicator plate wheel as the cementing plug passes completely through the indicator module bore.

Referring again to FIGS. 1–14 it will be appreciated that when both the top plug 33 and bottom plug 35 are sequentially forced through the indicator module bore 26, the top plug ribs 34 of the top plug 33 and the bottom plug ribs 36 of the bottom plug 35 contact the drop arm 74 of the plug pass indicator 27 and force the drop arm 74 downwardly against the tension in the return spring 82. As illustrated in FIGS. 11 and 12, when the cementing plug container 1 is loaded with the top plug 33 and the bottom plug 35, the drop arm 74 is in the position indicated in FIGS. 11 and 12. As illustrated in FIGURE 13, when the bottom plug 35 is dropped and enters the indicator module bore 26 and contacts the drop arm 74, the drop arm 74 is forced downwardly in the indicator module bore 26, as indicated by the arrow. This movement of the drop arm 74 causes the shaft 63, indicator plate wheel 58 and the collar bracket 76 to rotate, as illustrated. As the bottom plug 35 continues to move downwardly through the indicator module bore 26 responsive to the fluid pressure differential, the drop arm 74 continues to pivot downwardly and finally pivots into the bore cavity 90, as illustrated in FIG. 14. When the drop arm 74 is in this extreme downward position, the indicator plate wheel 58 is rotated one-fourth of a complete revolution and the red panel 60 is located in the relative position which the white panel 61 occupied when the drop arm 74 was in the position illustrated in FIG. 12. The collar bracket 76 thus extends outwardly of the indicator module 24 against the bias of the return spring 82 and when the bottom plug 35 has moved through the indicator module bore 26 and past the bore cavity 90, the return spring 82 causes the drop arm 74 and collar bracket 76 to return to the original position illustrated in FIGS. 11 and 12. However, as heretofore described, while the shaft 63, clutch collar 64 and the inner race 67 of the cam clutch 65 also return to the respective original positions illustrated in FIGS. 11 and 12 responsive to the bias in the return spring 82, the outer race 66 and indicator plate wheel 58 remain in the one-quarter turn configuration. The plug pass indicator 27 is then in the "READY" position to indicate passage of the top plug 33 through the indicator module bore 26.

Referring again to FIGS. 2, 11 and 12 of the drawings the sensor head 89 of the proximity sensor 81*a* is separated from the pivoting sensor plate 81 and as long as this relative position of the sensor plate 81 and sensor head 89 exists, the electromagnetic field developed by the proximity sensor 81*a* is unbroken and neither the top plug light 111 or the bottom plug light 112 located on the control panel 91 are illuminated. However, when the bottom plug 35 forces the drop arm 74 downwardly and the collar bracket 76 outwardly, the sensor plate 81 swings outwardly with the collar bracket 76 and away from the sensor head 89. When the sensor plate 81 moves away from the sensor head 89 in this manner, the electromagnetic field is broken and the proximity sensor 81*a* sends a signal to the control panel 91 through the plug light wiring 113, which signal illuminates the bottom plug light 112, thereby notifying the operator that the bottom plug 35 has passed through the indicator module bore 26 and into the well. The sequence is orchestrated by the circuit board 114 and is repeated to illuminate the top plug light 111 when the bottom plug 35 is ejected through the indicator module 24.

Referring again to FIGS. 1 and 4–6 of the drawings, it is understood that the top plug release 4 and the bottom plug release 13 can be manually manipulated if desired, by grasping the top cam lock 8 and bottom cam lock 16, unthreading the top cam lock 8 and bottom cam lock 16 from the respective cylinder piston rods 6 and then forcing the top cam lock 8 and bottom cam lock 16 forwardly against the cam lock release pins 42, respectively, to sequentially release the bottom plug 35 and top plug 33. It is further understood that while the upper housing 2, lower housing 11, dome 20, indicator module 24 and well pipe connector 25 can be fabricated of substantially any material, aluminum is a preferred material of construction, in order to reduce weight and enhance the portability of the cementing plug container 1. Steel is another preferred material of construction for certain applications requiring very high operating pressure.

It will be appreciated that the cementing plug container of this invention is characterized by utility, convenience and efficiency, since it can be manually or remotely operated, using one or more cementing plugs of various design. The cementing plug container is designed to use interchangeable housing parts and an appropriate control system, such as the system disclosed herein, utilizing a variety of working fluids, including compressed air, nitrogen, hydraulic fluid and oil, in non-exclusive particular, as the source of power for operating the plug release mechanism or mechanisms. While two cementing plugs are illustrated in the drawings, it will be appreciated that additional plugs of any desired design supported by additional plug release mechanisms can be implemented in a corresponding cementing plug container, as desired.

As heretofore described, in a most preferred embodiment of the invention and referring again to FIG. 19 of the drawings, the control system for the top plug release 4 and the bottom plug release 13, as well as the top plug light 111 and bottom plug light 112, which indicate the passage of the top plug 33 and bottom plug 35 through the indicator module bore 26, are securely mounted on the control panel 91. The control panel 91 can be remotely located from the cementing plug container 1 for ease and safety in monitoring and operating the cementing plug container 1, as described herein. It will be appreciated that by the term "remotely located," it is intended that the control panel 91 can be removed any desired distance from the cementing plug container 1 and the well location, which distance is limited only by the practical length of the working fluid conduit and electrical lines connecting the cementing plug container 1 and the control panel 91. Furthermore, while fluid operation of the cementing plug container 1 is preferred, other means for remotely operating the plug release mechanisms, such as radio control and electric motors, can also be used, according to the knowledge of those skilled in the art.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A cementing plug container and remote control system for controlling the insertion of cementing plugs in a well pipe, comprising a housing having a hollow interior, said housing adapted for attachment to the well pipe; at least one plug release means carried by said housing and extending into said hollow interior for supporting and sequentially releasing the cementing plugs in said hollow interior; and a plug pass indicator located below said plug release means for indicating passage of the cementing plugs through said cementing plug container, said plug pass indicator further comprising a drop arm bracket disposed inside said hollow interior of said housing and a drop arm carried by said drop arm bracket, said drop arm normally projecting into the path of the cementing plugs; a shaft rotatably extending from said drop arm bracket through said housing; bias means provided in mechanical cooperation with said shaft for normally biasing said drop arm in the path of the cementing plugs; a cam fixedly carried by said shaft and an indicator plate wheel rotatably carried by said cam, whereby said indicator plate wheel and said shaft rotate a selected distance from a first position to a second position responsive to rotation of said drop arm inside said hollow interior and said indicator plate wheel remains at said second position, but said shaft and said drop arm return to said first position responsive to operation of said bias means, for rotatably indicating when said drop arm is deflected inside said hollow interior of said housing responsive to passage of the cementing plugs through said hollow interior and operation of said cam.

2. The cementing plug container and remote control system of claim 1 wherein said plug release means is a first plug release means for supporting a first cementing plug and a second plug release means for supporting a second cementing plug, said second plug release means being positioned in spaced, vertical relationship with respect to said first plug release means.

3. The cementing plug container and remote control system of claim 2 further comprising a first valve remotely located from said cementing plug container and a second valve spaced from said first valve and further comprising a first fluid conduit communicating with said first valve and said first plug release means and a second fluid conduit communicating with said second valve and said second plug release means for releasing the first cementing plug and the second cementing plug in a selected sequence.

4. The cementing plug container and remote control system of claim 3 further comprising:

(a) a proximity sensor carried by said housing, said proximity sensor adapted to open and close responsive to operation of said plug pass indicator; and (b) at least one signal means remotely located from said housing and provided in electrical connection to said proximity sensor, whereby energizing of said proximity sensor responsive to contact between the cementing plugs and said drop arm activates said signal means.

5. The cementing plug container and remote control system of claim 4 wherein said at least one signal means is a first light means and a second light means provided in electrical connection to said proximity sensor for sequentially indicating release of the cementing plugs from said first plug release means and said second plug release means responsive to operation of said first valve and said second valve.

6. The cementing plug container and remote control system of claim 3 further comprising a control panel remotely located from said housing and wherein said first valve and said second valve are mounted on said control panel.

7. The cementing plug container and remote control system of claim 3 further comprising:

(a) a control panel remotely located from said housing and wherein said first valve and said second valve are mounted on said control panel; and (b) at least one signal means mounted on said control panel and provided in electrical connection to said proximity sensor, whereby the sequential energizing of said proximity sensor responsive to contact between the cementing plugs and said drop arm sequentially activates said signal means.

8. The cementing plug container and remote control system of claim 7 wherein said at least one signal means is first light means and second light means provided in electrical connection to said proximity sensor for sequentially indicating release of the cementing plugs from said first plug release means and said second plug release means responsive to operation of said first valve and said second valve.

9. The cementing plug container and remote control system of claim 1 further comprising actuator means provided in fluid communication with said hollow interior of said housing, an actuator valve remotely located from said housing and actuator fluid conduit means connecting said actuator means and said actuator valve for controlling entry of actuator fluids into said housing to force the cementing plugs into the well pipe.

10. The cementing plug container and remote control system of claim 9 further comprising a control panel remotely located from said housing and wherein said actuator valve is mounted on said control panel.

11. The cementing plug container and remote control system of claim 10 wherein said plug release means is a first plug release means for supporting a first cementing plug and a second plug release means for supporting a second cementing plug, said second plug release means being positioned in spaced, vertical relationship with respect to said first plug release means.

12. The cementing plug container and remote control system of claim 11 further comprising a first valve carried by said control panel and a second valve carried by said control panel and spaced from said first valve and a first fluid conduit communicating with said first valve and said first plug release means and a second fluid conduit communicating with said second vlave and said second plug release means for releasing the first cementing plug and the second cementing plug in a selected sequence.

13. The cementing plug container and remote control system of claim 12 further comprising:

(a) a proximity sensor carried by said housing, said proximity sensor adapted to open and close responsive to operation of said plug pass indicator; and (b) at least one signal means located on said control panel and provided in electrical connection to said proximity sensor, whereby energizing of said proximity sensor responsive to contact between the cementing plugs and said drop arm activates said signal means.

14. The cementing plug container and remote control system of claim 13 wherein said at least one signal means is a first light means and a second light means provided in electrical connection to said proximity sensor for sequentially indicating release of the cementing plugs from said first plug release means and said second plug release means responsive to operation of said first valve and said second valve.

15. A cementing plug container and remote control system for controlling the release of cementing plugs into a well pipe, comprising an elongated housing having an inner axial bore communicating with the well pipe at one end of said housing; a dome removably closing the opposite end of said housing; first plug release means carried by said housing and extending into said bore for supporting and selectively releasing a first cementing plug for injection into the well pipe; second plug release means carried by said housing in spaced, vertical relationship with respect to said first plug release means, said second plug release means extending into said bore for supporting and selectively releasing a second cementing plug for insertion into the well pipe; a control panel remotely located from said housing; a plug pass indicator characterized by a drop arm bracket disposed inside said bore of said housing and a drop arm carried by said drop arm bracket, said drop arm projecting into the path of the cementing plugs; a shaft rotatably extending from said drop arm bracket through said housing; a collar bracket carried by said shaft and extending downwardly from said shaft outside said housing and bias means connected to said collar bracket and said housing for normally biasing said drop arm in the path of said cementing plugs; a cam fixedly carried by said shaft; and an indicator plate wheel rotatably carried by said cam, whereby said indicator plate wheel and said shaft rotate a selected distance from a first position to a second position responsive to rotation of said drop arm inside said bore and said indicator plate wheel remains at said second position, but said shaft and said drop arm return to said first position responsive to operation of said bias means, for rotatably indicating when said drop arm is deflected inside said bore of said housing responsive to passage of the cementing plugs through said bore and operation of said cam; switch means carried by said housing, said switch means adapted to open and close responsive to operation of said plug pass indicator; at least one light means mounted on said control panel and provided in electrical connection to said switch means, whereby sequential energizing of said switch means responsive to sequential contact between the cementing plugs and said drop arm in said plug pass indicator causes seuqential illumination of said light means; first valve means and second valve means mounted in spaced relationship on said control panel; first fluid conduit means connecting said first plug release means to said first valve means and second fluid conduit means connecting said second plug release means to said second valve means; actuator means provided in fluid communication with said bore in said housing; an actuator valve mounted on said control panel and third fluid conduit means connecting said actuator means to said actuator valve, whereby the cementing plugs are sequentially released from said first plug release means and said second plug release means responsive to operation of said first valve means and said second valve means and fluid is caused to flow into said bore of said housing by operation of said actuator valve to sequentially force the cementing plugs into the well pipe.

16. The cementing plug container and remote control system of claim 15 wherein said at least one light means further comprises a battery, a first light and a second light mounted in spaced relationship on aid control panel and said switch means is a proximity sensor provided in electrical connection to said battery and said first light and said second light, whereby contact between the cementing plugs and said drop arm in said cementing plug indicating means sequentially energizes said proximity sensor and sequentially illuminates said first light and said second light.

* * * * *